United States Patent [19]

Anders

[11] 4,030,258

[45] June 21, 1977

[54] BANK WINDOW CONSTRUCTION

[75] Inventor: Walter G. Anders, Canton, Ohio

[73] Assignee: Diebold, Incorporated, Canton, Ohio

[22] Filed: Oct. 12, 1976

[21] Appl. No.: 731,123

[52] U.S. Cl. ..... 52/208; 49/505; 52/212; 52/476; 109/10

[51] Int. Cl.[2] ..... E06B 5/00

[58] Field of Search ..... 52/204, 208, 212, 474, 52/476, 499; 49/505; 109/2, 10

[56] References Cited

UNITED STATES PATENTS

| | | | |
|---|---|---|---|
| 1,995,819 | 3/1935 | Rogers | 109/10 |
| 2,386,151 | 10/1945 | Trautvetter | 52/208 |
| 2,565,747 | 8/1951 | Van Fleet | 49/505 |
| 2,996,767 | 8/1961 | Kobil et al. | 52/212 |
| 3,018,524 | 1/1962 | Schlegel | 52/212 X |
| 3,969,857 | 7/1976 | Stark | 52/208 |
| 3,994,243 | 11/1976 | Anders | 52/208 X |

*Primary Examiner*—J. Karl Bell
*Attorney, Agent, or Firm*—Frease & Bishop

[57] ABSTRACT

A bank window frame structure wherein bullet-proof glass is installed from the outside of a bank building wall in which the frame is located, and the glass is clamped in the frame in a weather-proof manner with a sealed joint all around by clamping means accessible only at the inside of the building wall. All sill, head and side frame members are composed of cut lengths of formed channel-shaped, sheet metal, base and support members secured together in box-like cross-sectional arrangement. The glass is installed from the outside of the frame, with sealing gasket means around its perimeter, and is retained by a formed sheet metal retaining channel member which compresses the sealing gasket means to provide the weather-proofed joint. The clamping screw means for the retaining channel is accessible only at the inside of the frame. The simple bullet-proof glass window construction with a frame of formed sheet metal members is inexpensive to fabricate and install as a window of any desired size for a banking building.

7 Claims, 13 Drawing Figures

FIG.10
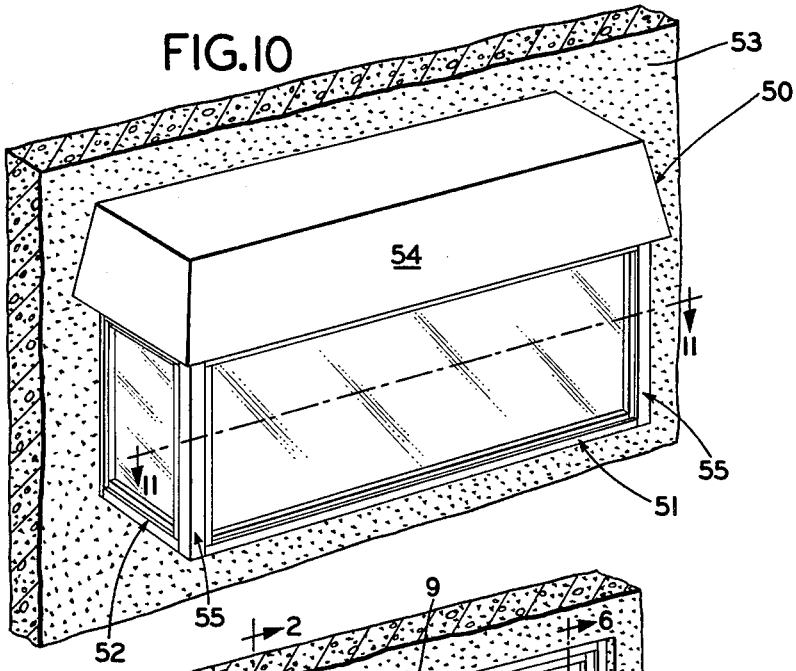
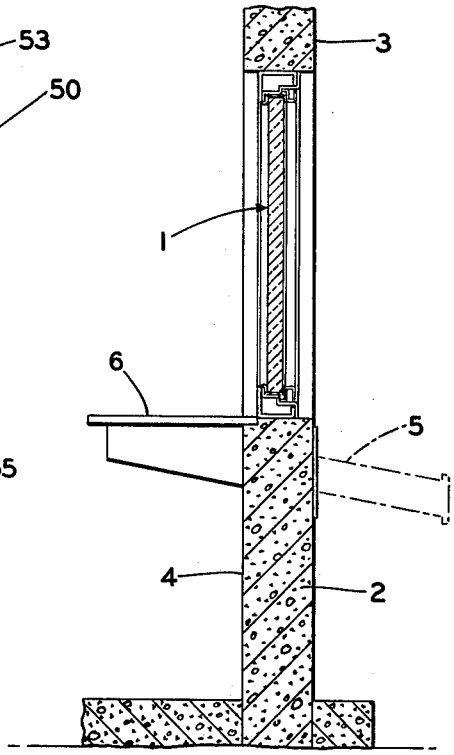
FIG.2
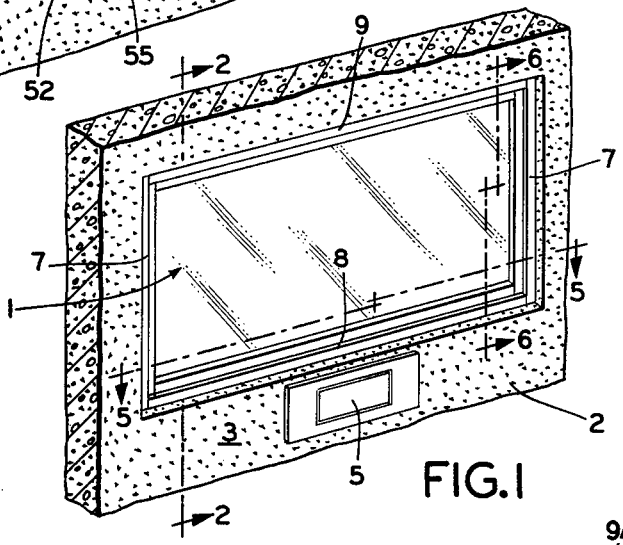
FIG.1
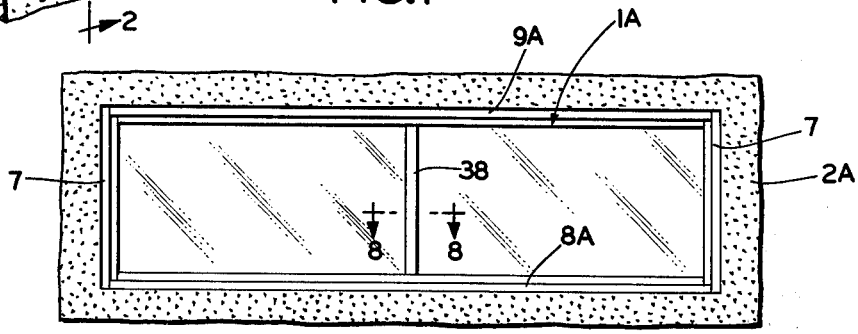
FIG.3
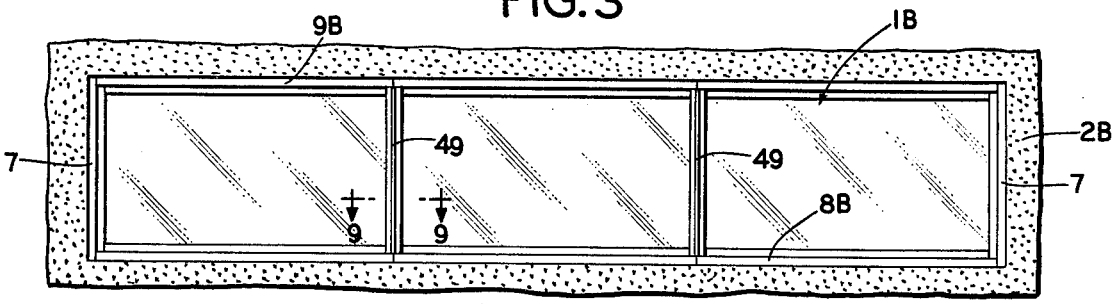
FIG.4

BANK WINDOW CONSTRUCTION

BACKGROUND OF THE INVENTION

1. Field of the Invention

The invention relates to a bullet-proof window for installation in the wall of a banking building to protect a bank teller carrying out a banking operation inside the window with visual communication with a customer outside the window. More particularly, the invention relates to an inexpensive metal frame composed of formed sheet metal sill, head and side members, in which bullet-proof glass may be installed from the outside of the window but clamped from the inside of the window to provide a sealed joint between the glass and frame that is weather-proof and need not be caulked, and is secure against attack by an intruder attempting to remove the bullet-proof glass from outside the building.

2. Description of the Prior Art

Bank windows in which bullet-proof glass may be installed in a modular manner for large banking buildings to accommodate various sizes of window-receiving openings and building walls of various thicknesses are known, in which bullet-proof glass may be installed from the exterior of the window and clamped from the interior thereof; for example, as shown in my application Ser. No. 528,004, filed Nov. 29, 1974, now U.S. Pat. No. 3,994,243.

Such prior bullet-proof glass window constructions, however, are too expensive to compete with bullet-proof glass windows installed by building contractors erecting small banking facility buildings at shopping centers and other locations remote from a main banking facility. In many instances, the local building contractors obtain bullet-proof glass from any available source, and construct a glass and window frame which is built into a building wall as the wall is being erected. Such frames are made of angle iron members, extruded metal members, or wooden members. Caulking is used to seal the bullet-proof glass in such frames. If it is necessary to replace the glass, the entire frame must be removed and rebuilt.

There are many known prior art wooden or metal frames for simple glass windows in residential buildings, business buildings, automobiles, and the like. The glass is clamped in such window frames by retaining means whose clamping screws or the like are accessible only at the same side of the frame at which the glass is entered into the frame, either at the inside or the outside of the wall in which the window frame is located. Examples of such prior art window frames are present in U.S. Pat. Nos. 2,386,151, 2,791,007, 2,995,221, 2,996,767, and 3,768,220.

It is undesirable to use a frame construction for bullet-proof glass in the wall of a banking building in which the clamping screws for the glass retaining means are accessible at the same side of the frame at which the glass is entered into the frame. If the retainer clamping means and glass entry are both located at the outside of the window, glass removal is possible by an intruder at a remote location of the building during the night season for entering the building.

If glass entry and clamping means are both located at the inside of the window, then if necessary to replace the bullet-proof glass, because of damage thereto, it is necessary to disturb banking operations and interrupt teller services in banking areas in the building at and leading to the window location, to transport the bullet-proof glass through such banking areas and to install the glass in the window frame, which is not desirable.

Accordingly, there is an existing need for a bullet-proof glass window construction for a bank building wall which is simple and inexpensive to fabricate and install, in which the bullet-proof glass may be readily replaced at the outside of the wall but clamped in retained position with clamping means only accessible at the inside of the wall, and in which a sealed weather-proof joint around the perimeter of the bullet-proof glass may be provided by the glass retainer clamping means without requiring caulking.

SUMMARY OF THE INVENTION

Objectives of the invention include providing a new bullet-proof glass bank window frame construction inexpensive to fabricate having formed sheet metal frame members in which a rectangular bullet-proof glass panel may be installed from the outside and clamped from the inside of the frame; providing such new window frame construction in which the sill, head and side frame members which receive the glass panel are composed each of the same cross-sectional shape of formed sheet metal base and support members assembled together to provide a rectangular support frame having sill, head and end frame members box-like in cross section and having first and second offset adjacent shoulder-like recesses for receiving and supporting the glass panel and glass retaining means; providing such new window frame construction with sealing means for the perimeter of the glass panel; providing such new window frame construction with a rectangular glass panel retainer channel member received in one of the recesses of the rectangular support frame having a pressure portion which clamps said sealing means adjacent both faces of the bullet-proof glass panel engaged between the retainer member and an abutment flange on the support frame when a clamping screw accessible at the inside of the window frame engaging the retainer member is tightened; providing such new window frame construction in which said clamping screws are located as closely as possible to a sealing means component covering the glass edge which component is located between said glass edge and the clamping screw; providing such new window frame construction in which the channel-shaped glass retainer member has a foot flange at the outer edge of one of the channel legs engaging a wall of the other support frame recess to prevent the retainer member from bulging when the clamping screws are tightened in nuts carried by the retainer member, and enabling maximum pressure to be exerted by the retainer member pressure portion on the glass sealing means; providing such new window frame construction in which the sealed joint between the glass panel and support frame resulting from glass retainer member pressure on the sealing means is weather-proof and does not require caulking of the glass panel in the support frame; providing such new window frame construction which may be used for framing two or more glass panel lights when necessary to accommodate bullet-proof glass panels of lengths insufficient to be mounted as a single glass panel in a support frame longer than standard length bullet-proof glass panels; providing such new window frame construction with the same support frame and retainer channel components with modified corner post members to install a bay-window-type bullet-proof window with side lights in a bank building wall; and providing such new window frame construction for bullet-proof bank windows which achieves the stated objectives in an effective, efficient, and inexpensive manner, which may be manufactured, installed and repaired for glass replacement readily, and which solves problems and satisfies needs existing in the art.

These and other objects and advantages may be obtained by the new bullet-proof glass bank window frame construction and assembly, the general nature of which may be stated as including a rectangular support frame having sill, head and end frame members; a rectangular retainer frame having sill, head and end frame members; each support frame member being composed of a base member and a stepped support member joined together to form a box-like shape in cross section; the base member being channel-shaped in cross section having long and short leg flanges; the stepped support member being zig-zag, double Z-shaped in cross section having spaced end flanges parallel with an intermediate wall and having parallel recess walls offset from each other and extending at right angles to the end flanges and connecting the end flanges with the intermediate wall; the base member leg flanges being joined preferably by welding, respectively, to the stepped support member end flanges; the offset recess walls of the rectangular support frame stepped support members forming adjacent shouldered glass panel and rectangular retainer frame receiving recesses; each retainer frame member having a channel-shape in cross section with channel legs extending from a web forming a channel chamber, and having a foot flange extending laterally outward from the open end of one of the legs; bolt-receiving nut means mounted on said one leg in the channel chamber adjacent said foot flange at spaced intervals; spaced slot means extending from an end flange to the intermediate wall of the stepped member recess wall which extends from the end flange that is joined with the long base member flange; clamping bolt means engaging and extending through said joined flanges and through one of said recess wall slot means and engaged with the nut means in the retainer channel chamber; a bullet-proof glass panel located in the glass panel recess when a rectangular retainer frame is located in the retainer frame receiving recess with its foot flanges engaged with said intermediate walls; sealing means in said panel recess around the perimeter of the glass panel, between the glass panel and the footed legs of retainer channel members; and the clamping bolt means when tightened clamping the glass panel edges in and compressing the sealing means against the glass panel edges in the panel recess to form a weather-proof seal for the panel in the support frame.

BRIEF DESCRIPTION OF THE DRAWINGS

Preferred embodiments of the invention — illustrative of the best modes in which applicant has contemplated applying the principles — are set forth in the following description and shown in the drawings and are particularly and distinctly pointed out and set forth in the appended claims.

FIG. 1 is a diagrammatic perspective view of the new window frame construction built into a bank building wall;

FIG. 2 is a diagrammatic vertical sectional view looking in the direction of the arrows 2—2, FIG. 1, illustrating the new window frame construction with a teller station at the inside of the wall and a customer station outside the wall for visual communication through the glass between a teller and customer;

FIG. 3 is a front view similar to FIG. 1 showing a two-light installation of the improved window frame construction;

FIG. 4 is a view similar to FIG. 3 illustrating a three-light installation of the improved window frame construction;

FIG. 10 is a diagrammatic perspective view of a modified form of construction in which the new window frame is incorporated in a bay window with side lights;

Similar numerals refer to similar parts throughout the various figures of the drawings.

DESCRIPTION OF PREFERRED EMBODIMENTS

First Embodiment

Figure 5:
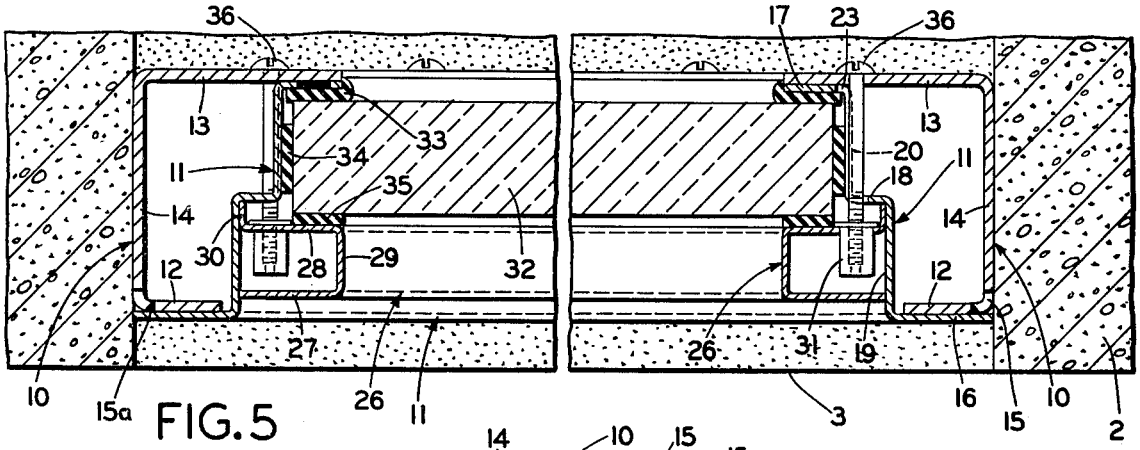
FIG. 5 is a plan sectional view taken on the line 5—5, FIG. 1.

A bank window incorporating the features and concepts of the invention is indicated generally at 1 in FIGS. 1 and 2 installed in a bank building wall 2 having an outer or exterior surface 3 and an inner or interior surface 4. A deal drawer, indicated in dot-dash lines at 5 in FIG. 2 and in full lines in FIG. 1, may be located below the window 1 actuated by a teller at the teller desk 6. The deal drawer may be any one of the types shown in U.S. Pat. Nos. 3,237,853 and 3,302,871.

The new bank window construction 1A having two standard sized bullet-proof glass panels installed in a building wall 2A is shown in FIG. 3; and FIG. 4 illustrates a three-glass panel window 1B installed in a building wall 2B.

The windows 1, 1A and 1B all have the same rectangular metal frame and glass retainer structures characterizing the invention . The main side frame members 7 are the same at the ends of all windows 1, 1A and 1B. The sill frame members 8, 8A and 8B of windows 1, 1A and 1B, respectively, are the same in all windows except for length. The head frame members 9, 9A and 9B are the same as the sill frame members 8, 8A and 8B, respectively, in windows 1, 1A and 1B. The indication that the various frame members 7, 8, 8A, 8B, 9, 9A and 9B are all the same means that they have the same cross-sectional configuration and are formed from simple formed sheet metal, preferably sheet steel, components described in detail below.

It is desired where possible to use standard sized bullet-proof glass panels, sometimes called bullet-resisting glass panels, formed of laminated bullet-resisting glass. However, the new window construction is adapted for mounting panels of any size called for in the specifications for windows of a bank building, since the frames for windows 1, 1A or 1B may be fabricated to have any size as to height and length by merely changing the lengths of the sill, head and end members to satisfy the specifications for a desired frame.

Figure 6:
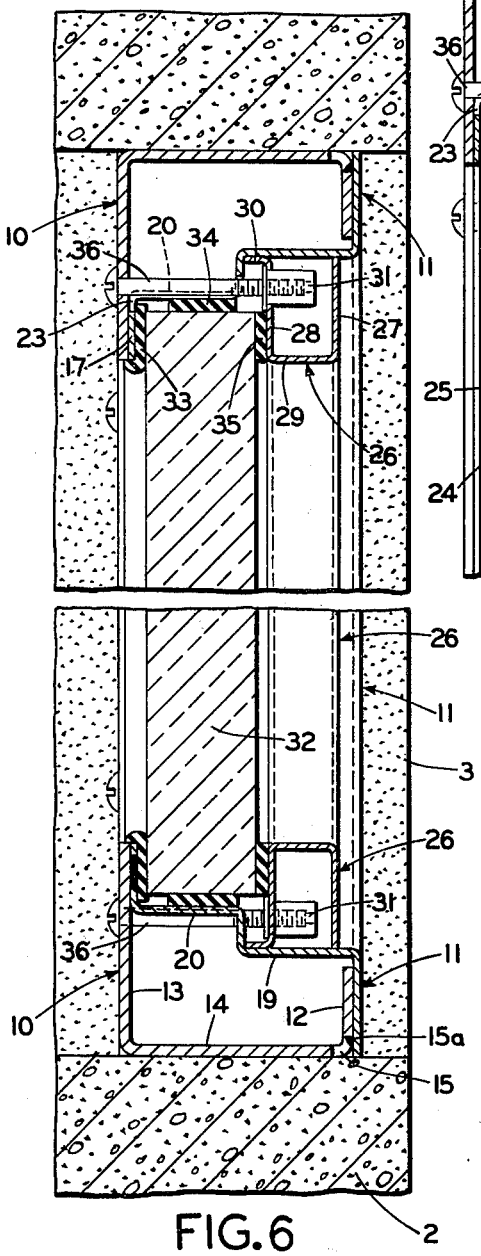
FIG. 6 is a vertical sectional view looking in the direction of the arrows 6—6, FIG. 1.
Figure 7:
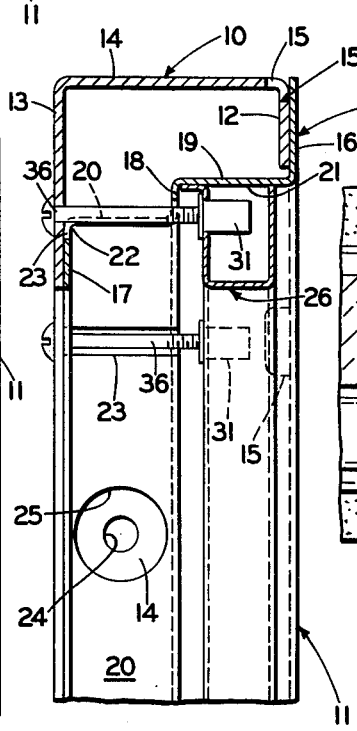
FIG. 7 is a view similar to a portion of FIG. 6 showing the frame and retainer in assembled position but with the glass panel and sealing means removed.

Each frame, sill, head or end member has the same construction as shown in FIGS. 5, 6 and 7. Each member includes a channel-shaped base member 10 and stepped or modified Z-shaped support member 11, and each is fabricated as a formed sheet metal section. Base memnber 10 preferably is fabricated of heavier gauge metal than the support member 11. Base member 10 is channel-shaped in cross section and has a short leg 12 and a long leg 13 extending from the channel web 14. Slots 15 are formed at spaced intervals along base member 10 at the corner between the short leg 12 and the web 14, as best shown in FIG. 7.

The stepped or modified Z-shaped support member 11 has parallel end flanges 16 and 17 and an intermediate wall 18. Flanges 16 and 17 and wall 18 are connected by stepped recess walls 19 and 20. Walls 19 and 20 extend at right angles to their connected flanges 16 and 17 and intermediate wall 18, thereby forming a plurality of offset shouldered recesses 21 and 22 formed, respectively, by walls 18 and 19, and by flange 17 and wall 20.

Members 10 and 11 are assembled together by spot welding flanges 13 and 17 together at spaced intervals, and by welding leg 12 to flange 16, as indicated at 15*a*, in the spaced slots 15.

When members 10 and 11 are assembled and joined together as described, they form a box-like support member with offset recesses 21 and 22. Slots 23 are formed at spaced intervals in stepped wall 20 extending at right angles to and between the end flange 17 and the intermediate wall 18 of member 11 for a purpose to be described.

Apertures 24 are formed in the web 14 of base member 10 at spaced intervals along the length of member 10 for receiving anchor bolts used to anchor the window frame to the building wall 2. Larger openings 25 aligned with openings 24 are formed at spaced intervals in wall 20 of member 11. The openings 25 provide access for inserting anchor bolts into bolt openings 24 and for inserting a socket wrench into the box-like interior of the support frame member to secure anchor bolts to the building wall 2.

As stated, the assembled base and stepped members 10 and 11 which form box-like frame members are the same in cross section. Cut lengths of such frame member assemblies form the sill, head and end frame members of a window frame. Such frame members are joined in a usual manner, for example, by welding at the corners to fabricate a rectangular glass panel support frame.

A glass retainer channel member 26 is formed with channel legs 27 and 28, and a web 29. Channel leg 28 terminates in an outturned foot flange 30. Preferably plastic speed nuts 31 are mounted in apertures in channel leg 28 at spaced intervals extending within the channel of member 26. Nuts are located to be aligned with the slots 23 for a purpose described below, when a rectangular retainer frame composed of sill, head and end glass retainer channel members is inserted in glass retaining position within a rectangular glass panel support frame. Such position is illustrated in FIG. 7 with the glass removed and in FIG. 6 with glass retained in the rectangular support frame.

Before placing a glass panel 32 in position in a rectangular support frame, sealing strips 33, 34 and 35 are placed in position in the rectangular frames for sealing the perimeter of the glass panel 32 in the support and retainer frames.

The sealing strips 33, 34 and 35 are formed of a suitable compressible gasket material with a pressure sensitive adhesive coating on one side thereof. Thus, as shown for example in FIG. 6, strip 33 is placed adhering to the flange 17 of member 11 at one side of recess 22, and strip 34 is placed adhering to the recess wall 20. Strip 35 is placed on the pressure area of channel leg 28 of retainer member 26 adjacent the corner between web 29 and leg 28, also as shown in FIG. 6.

After sealing strips 33, 34 and 35 have been placed in such positions at all sides of rectangular support frame and along all sides of a rectangular retainer frame, a glass panel 32 may be inserted into the rectangular support frame and located within the glass-receiving recess 22. Then, the rectangular retainer frame is inserted into the support frame within its retainer receiving recess 21. Then clamping screws of bolts 36 are inserted through holes formed in the long legs 13 of support frame base members 10, to extend through the box-like compartment and engage the nuts 31 carried by the retainer frame into which the bolts 36 are threaded.

As the clamping bolts 36 are tightened, the pressure areas of the retainer frame which carry the sealing strips 35 exert a clamping pressure on the sealing strips 35 and through the glass on sealing strips 33 all around the window frame opening to form tight, sealed, weather-proof joints.

The clamping bolts 36, as best shown in FIG. 7, extend through the slots 23 formed in the walls 20 of members 11 and bolts 36 thus are located as close as possible to the edges of the glass panel 32 and are engaged with sealing strips 34 (FIG. 6).

The foot flanges 30 on the retainer frame engage the intermediate walls 18 of members 11 at the corners of the retainer recesses 21 between walls 18 and 19 so as to support the channel legs 28 of retainer members 26 against bulging or bending as the clamping bolts are tightened.

The foot flanges 30 along with the pressure areas of channel leg 28 engaging the sealing strip 35 also form bridge supports for the channel legs 28 between the foot flange 30 and the pressure areas, so that the clamping bolts 36 pull with tension against the channel legs intermediate the ends of the bridged portion of channel legs 28.

The foregoing description of the installation of a glass panel 32 in the improved bank window frame construction indicates that the glass panel 32 is inserted in the window frame from the outside thereof and that the glass panel 32 is clamped in retained position by clamping bolts 36 which are accessible only at the inside of the frame. The described procedure applies both to the initial installation of the improved bank window construction and to the replacement of glass panels 32 at any time that one has been damaged.

Further, the engagement and clamping of the retainer frame for retaining the glass panel 32 in the support frame provides the further function of compressing the sealing means against both glass surfaces around the perimeter of the glass panel 32 to establish a very efficient and dependable weather-proof seal, which avoids any requirement of caulking the retainer frame. The retainer frame also acts as a trim molding for the window frame. The closeness of the clamping bolts 36 to the edges of the glass panel 32 provides the maximum possible clamping force against the sealing strips and glass.

The new bank window 1 normally is installed in a building as the walls thereof are being erected. A rectangular support frame without glass or retainer frame is located in an opening formed in the wall 2. Anchor bolts engage the frame with the wall through the anchor bolt openings 24. As the building is being completed, a glass panel 32 is inserted in the frame and clamped and retained therein as described.

Figure 8:
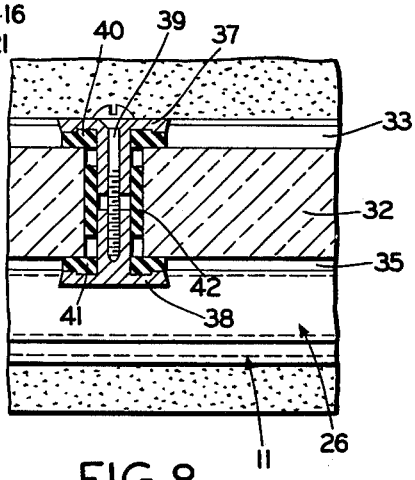
FIG. 8 is a fragmentary section taken on the line 8—8, FIG. 3.

There is no change in the fundamental construction in accordance with the concept of the invention of the two-light window installation of FIG. 3 from that of the single panel installation of FIG. 1, except for the length of the frame and the provision of joint means between the adjacent glass panels of the two-light frame. The joint means is best illustrated in FIG. 8.

The joints may be formed by inner and outer T-shaped members 37 and 38, bolted together from the interior by clamping bolts 39. Sealing means strips 40, 41 and 42 initially adhering to the T-shaped members provide clamped sealing means at the joint, functioning in the same manner as the sealing of the glass panel by sealing strips 33, 34 and 35, as described. The vertically extending T-members forming the joint between adjacent glass panels in FIG. 3 may be secured to the sill and head members 8A and 9A of the frame for window 1A.

The three-light window installation of FIG. 4 may have too long a span between the side frame members 7 to provide the necessary support for the lengthy sill and head frame members 8B and 9B. Additional support may be provided, however, by a different vertical joint construction than in FIG. 3, between the three glass panels, best shown in FIG. 9.

Figure 9:
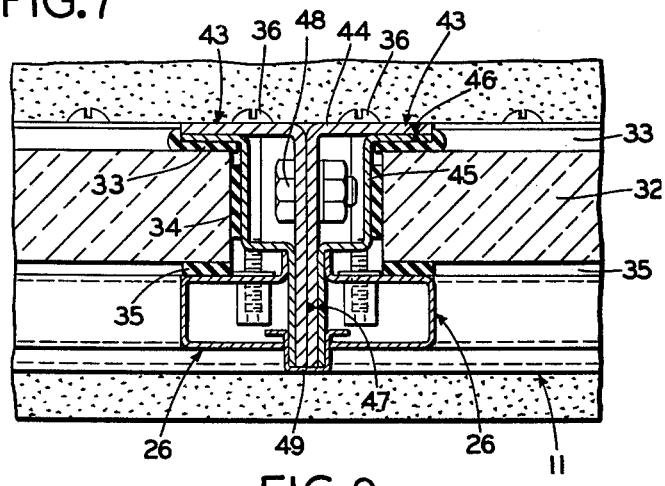
FIG. 9 is a fragmentary section taken on the line 9—9, FIG. 4.
Figure 11:
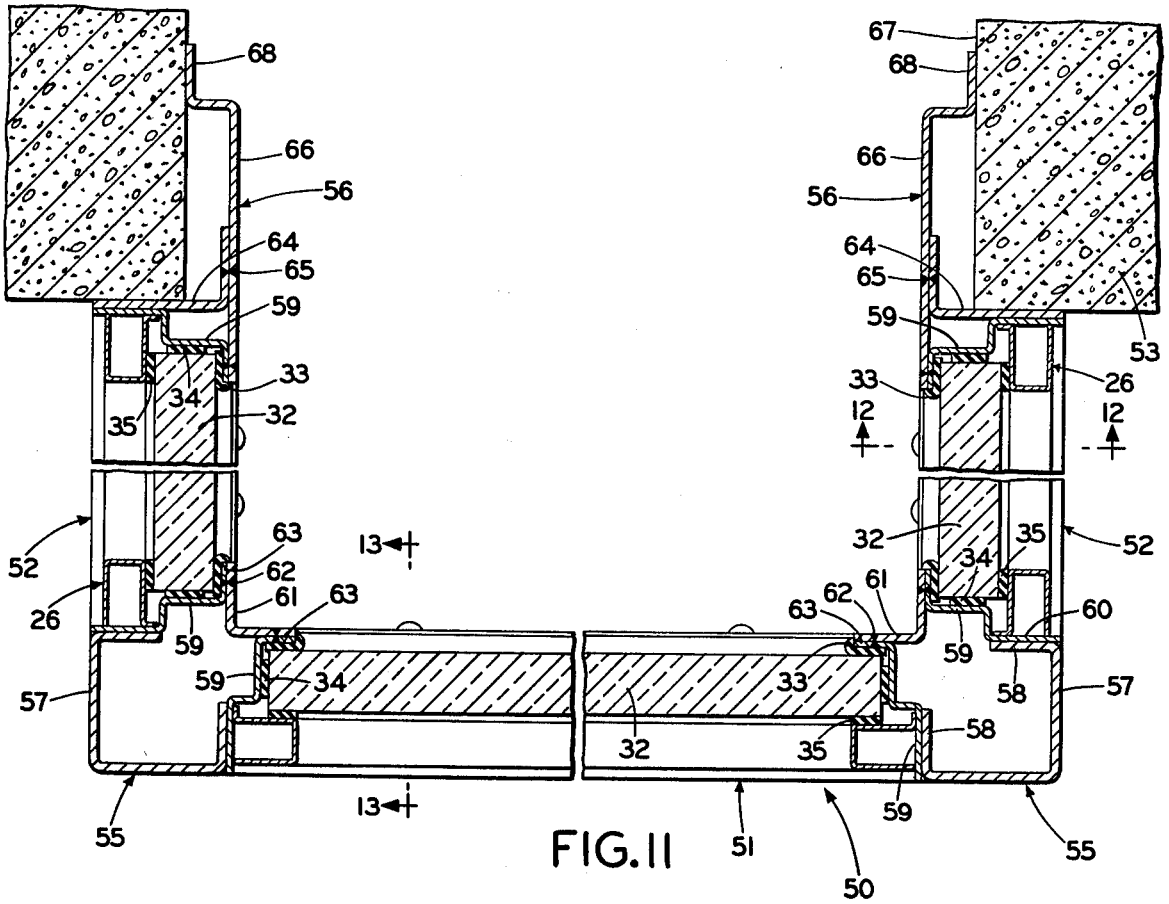
FIG. 11 is a plan sectional view taken on the line 11—11, FIG. 10.
Figure 13:
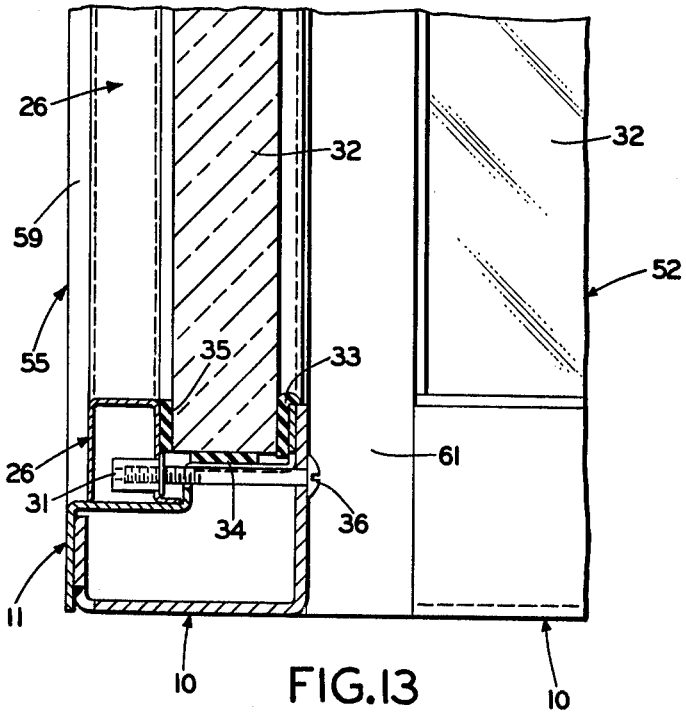
FIG. 13 is a sectional view taken on the line 13—13, FIG. 11.
Figure 12:
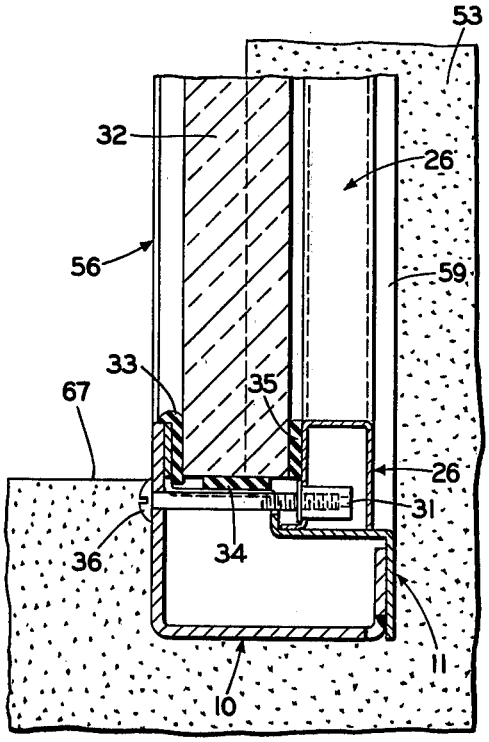
FIG. 12 is a sectional view looking in the direction of the arrows 12—12, FIG. 11.

The joint construction of FIGS. 4 and 9 involves duplicate frame support members generally indicated at 43, constructed of essentially the same components as the assembled frame support members composed of a base member 10 and a support member 11.

Each member 43 has a base member 44 similar to the base member 10 but omitting the short leg 12 and reducing the length of the longer leg 13. The other component of the member 43, namely the stepped member 45, is similar to the stepped member 11 but omits the end flange 16 thereof. The members 44 and 45 may be welded together at spaced intervals as indicated at 46 and 47.

Substantially, the same glass retainers 26, clamping bolts 36 and sealing strips 33, 34 and 35 of the single-light frame, may be used in the construction of the reinforced vertical joint members shown in FIG. 9. Two frame support members 43 are bolted together, back to back, by bolts 48. Before retainer members 26 are bolted in place, a U-shaped trim member 49 may be engaged over the outer edges of abutting flanges of the two support frame members 43.

The vertical joint members shown in FIGS. 8 and 9 are both sealed in a weather-proof manner and provide minimum widths of upright members and thus minimum interference with vision through the windows.

Second Embodiment

The improved bank window construction is incorporated in a bay window-type bank window, shown in FIGS. 10 through 13. The bay window, generally indicated at 50, has a main front window frame, generally indicated at 51, and side lights or side window frames 52. The floor of the bay, not shown, is a continuation of the teller's counter within the bank building inside wall 53 from which the bay window 50 outwardly extends. A suitable canopy 54 may be used as the top or roof of the bay window 50.

The window frame sill and head members for the front and side windows 51 and 52 are essentially the same in construction as those shown and described in connection with FIGS. 1 through 9. Thus, the sill frame members for the bay window front and side windows 51 and 52 (FIGS. 12 and 13) are identical with the sill frame member for window 1, shown in the lower part of FIG. 6. The bay window 50, however, requires a slight modification in construction of the bay window corner posts, generally indicated at 55, and in the rear side-light-wall posts, generally indicated at 56.

Each corner post 55 is similar to the assembled support frame member formed of members 10 and 11, for example of FIG. 5, except that the corner post base member 57 has two inturned flanges 58, to each of which a stepped zig-zag Z-member 59 is connected, preferably by welding. Each member 59 is similar to the stepped member 11 except that the end flange 16 of member 11 is omitted. The corner post end flanges 58 are connected directly to the retainer recess-forming wall 60 which is the same as wall 19 of member 11. Two zig-zag members 59 are assembled with corner post base member 57 in forming a corner post assembly which is completed by angle member 61 joined by welding at 62 with the end flanges 63 of members 59. End flanges 63 of members 59 are the same as the end flanges 17 of members 11.

The rear posts 56 for side lights 52 are similar to the support frame members 43, shown in FIG. 7, except that the base member of rear post 56 comprises angle member 64 welded at 65 to and offset wall mounting member 66 which may be secured in the wall window opening 67 of wall 53 by anchor bolts, not shown, engaged with foot flange 68.

In all other respects, the same types of glass panels, rectangular retaining frames, sealing means strips, clamping bolts, etc. are used in the front and side windows 51 and 52 of the bay window as are used in the bank 1 of FIGS. 1 to 9.

In General

The various members which form the rectangular bank window bullet-proof glass mounting frames in all embodiments and variations shown in the drawings of single and multiple glass panel frames and bay window front and side frames incorporate the concepts of the invention by providing simple frame structures in which bullet-proof glass panels may be installed, mounted or replaced from the outside of the window frame and clamped in retained position by clamping bolt means accessible only at the interior of the frame which clamping bolt means cooperates with the glass retaining means engaged by the clamping bolt means to establish an effective and efficient sealed weather-proof joint around the periphery of each glass panel.

Accordingly, the new bank window construction provides for the simple and inexpensive manufacture, installation and use of bank window frames which satisfy the objectives stated, eliminate problems heretofore existing in the art, and obtain the new results described.

In the foregoing description, certain terms have been used for brevity, clearness and understanding; but no unnecessary limitations are to be implied beyond the requirements of the prior are because such terms are used for descriptive purposes and are intended to be broadly construed.

Moreover, the description and illustration of the invention is by way of example, and the scope of the invention is not limited to the exact details shown or described.

Having now described the features and principles of the invention, the manner in which the new bank window construction is designed, built, installed, and repaired, and the advantageous, new and useful results obtained; the new and useful structures, devices, components, elements, arrangements, parts, combinations and relationships are set forth in the appended claims.

I Claim:

1. Bullet-proof glass bank window frame construction including a rectangular support frame having sill, head and end frame members; offset glass-panel-receiving and retainer-frame-receiving recesses formed in the support frame members opening toward the central portion of the support frame and located between the outside and inside portions of the support frame; a glass panel located in the panel-receiving recess adjacent the inside portion of the support frame; a rectangular retainer frame located in the retainer-frame-receiving recess adjacent the outside portion of the support frame; the retainer frame having pressure areas facing and adjacent the perimeter of the glass panel; sealing strip means in the panel-receiving recess between the support frame and the pressure areas and perimeter surfaces of the glass panel; clamping bolt means accessible at the inside portion of the support frame and extending through the support frame and engaging the retainer frame to retain the glass panel in the panel-receiving recess; and the clamping bolt means when tightened compressing the sealing means around the periphery of the glass panel to provide a weather-proof seal.

2. The construction defined in claim 1 in which the support frame, sill, head and end frame members each are composed of a base member and a stepped support member, in which the base member in channel-shaped in cross section having leg flanges; in which the stepped support member is zig-zag double Z-shaped in cross section having support end flanges parallel with an intermediate wall and having parallel recess walls offset from each other and extending at right angles to the end flanges and connecting the end flanges with the intermediate wall; in which the base member leg flanges and the stepped support member end flanges are joined together, respectively, to form a box-like shape in cross section; in which the stepped support member offset recess walls form the glass panel and rectangular retainer frame receiving recesses; and in which the recesses are adjacent one another and each has a shoulder-like corner.

3. The construction defined in claim 2 in which slot means are formed at spaced intervals in the recess wall of the panel-receiving recess extending from a stepped member end flange to the stepped member intermediate wall; and in which the clamping bolt means extend in and along said slot means from the inside portion of the support frame to engage the retainer frame.

4. The construction defined in claim 1 in which the retainer frame has sill, head and end frame members each being channel-shaped in cross section and having channel legs extending from a web forming a channel chamber; in which a foot flange having an edge extends laterally outward from the open end of one of the legs; in which bolt receiving nut means are mounted at spaced intervals on said one leg in the channel chamber adjacent said foot flange; and in which the bolt-receiving nut means are engaged by the clamping bolt means to retain the glass panel in the rectangular support frame.

5. The construction defined in claim 4 in which the bolt-receiving nut means are located intermediate the retainer frame foot flanges and the retainer frame pressure areas.

6. The construction defined in claim 5 in which the retainer-frame-receiving recesses of the support frame members have shoulder-like corners; and in which the edges of the retainer frame foot flanges engage the shoulder corners to impart clamping force through the retainer frame pressure areas against the glass panel and sealing means when the clamping bolts are tightened.

7. The construction defined in claim 6 in which the sealing means comprises, sealing strips located in the panel-receiving recess between the rectangular support frame and one face of the glass along the perimeter thereof, other sealing strips located in the panel-receiving recess between the support member panel-receiving recess walls and the edges of the glass panel, and other sealing strips located in the panel-receiving recess between the retainer frame pressure areas and the other face of the glass.

* * * * *